US008557355B2

(12) United States Patent
Hann et al.

(10) Patent No.: US 8,557,355 B2
(45) Date of Patent: Oct. 15, 2013

(54) THERMAL TRANSFER PRINTING

(75) Inventors: Richard Anthony Hann, Ipswich (GB); Ian Stephenson, Essex (GB); Anthony Joseph Martino, Suffolk (GB); Nicholas Clement Beck, Essex (GB)

(73) Assignee: Akzo Nobel Coatings International B.V., Arnhem (NL)

( * ) Notice: Subject to any disclaimer, the term of this patent is extended or adjusted under 35 U.S.C. 154(b) by 1309 days.

(21) Appl. No.: 12/087,408

(22) PCT Filed: Jan. 8, 2007

(86) PCT No.: PCT/GB2007/000024

§ 371 (c)(1),
(2), (4) Date: Jul. 3, 2008

(87) PCT Pub. No.: WO2007/080377

PCT Pub. Date: Jul. 19, 2007

(65) Prior Publication Data

US 2009/0068383 A1 Mar. 12, 2009

(30) Foreign Application Priority Data

Jan. 12, 2006 (GB) ..... 0600576.3

(51) Int. Cl.

| | |
|---|---|
| ***B41M 5/00*** | (2006.01) |
| ***B41M 5/52*** | (2006.01) |
| ***B41M 5/44*** | (2006.01) |
| ***B44C 1/17*** | (2006.01) |

(52) U.S. Cl.

CPC ..... *B41M 5/52* (2013.01); *B41M 5/5254* (2013.01); *B41M 5/44* (2013.01); *B44C 1/1712* (2013.01); *B44C 1/1716* (2013.01)

USPC ..... 428/32.39; 428/32.51; 428/195.1; 156/230; 156/240

(58) Field of Classification Search

CPC ..... B41M 5/52; B41M 5/5254; B41M 5/44; B44C 1/1712; B44C 1/1716

USPC ..... 428/32.39, 32.51, 195.1; 156/230, 240

See application file for complete search history.

(56) References Cited

U.S. PATENT DOCUMENTS

| | | | | |
|---|---|---|---|---|
| 5,562,975 | A * | 10/1996 | Sugai et al. | 428/32.5 |
| 5,882,388 | A * | 3/1999 | Adair et al. | 106/31.6 |
| 6,057,070 | A * | 5/2000 | Ogura | 430/47.4 |
| 6,902,779 | B1 * | 6/2005 | de Visser et al. | 428/32.12 |
| 2002/0001597 | A1 | 1/2002 | Stuart et al. | 428/195 |
| 2003/0035038 | A1 * | 2/2003 | Nakajima | 347/103 |
| 2004/0265514 | A1 * | 12/2004 | Sakaguchi et al. | 428/32.34 |
| 2005/0157147 | A1 * | 7/2005 | Kapusniak et al. | 347/106 |
| 2005/0175819 | A1 * | 8/2005 | Kobayashi et al. | 428/195.1 |
| 2005/0179759 | A1 * | 8/2005 | Yoshida et al. | 347/105 |
| 2006/0070546 | A1 * | 4/2006 | Smith et al. | 101/488 |
| 2006/0182903 | A1 * | 8/2006 | Sakaguchi et al. | 428/32.24 |
| 2006/0263550 | A1 * | 11/2006 | Nichols et al. | 428/32.34 |

FOREIGN PATENT DOCUMENTS

| | | | |
|---|---|---|---|
| EP | 0 692 388 | A1 | 1/1996 |
| EP | 0 976 571 | A1 | 2/2000 |
| EP | 1 484 188 | A1 | 12/2004 |
| EP | 1 580 017 | A1 | 9/2005 |
| WO | WO 00/06392 | | 2/2000 |
| WO | WO 01/96123 | A1 | 12/2001 |
| WO | WO 2004/022354 | A1 | 3/2004 |

OTHER PUBLICATIONS

CABOT—Creating What Matters. Cab-O-Sil TS-610. 2002.*

* cited by examiner

*Primary Examiner* — Betelhem Shewareged
(74) *Attorney, Agent, or Firm* — Kenyon & Kenyon LLP

(57) ABSTRACT

A retransfer intermediate sheet for receiving an image to be printed onto an article by thermal retrasfer comprises a substrate which is preferably heat-deformable; and an image-receiving coating on one side of the substrate, comprising an image-receiving layer for receiving an image by printing, preferably inkjet printing, of dye-containing ink, the image-receiving layer comprising amorphous porous silica, a first, non-dye absorbing polymeric binder and a second, flexible polymeric binder. The sheet is particularly useful for printing on three dimensional articles, e.g. being heated and vacuum formed to conform to an article. The invention also coven a method of printing and an article bearing a printed image.

19 Claims, No Drawings

THERMAL TRANSFER PRINTING

FIELD OF THE INVENTION

This invention relates to thermal transfer printing, and concerns a retransfer intermediate sheet for receiving an image to be printed onto an article by thermal retransfer, a method of printing and an article bearing a printed image.

BACKGROUND TO THE INVENTION

Thermal retransfer printing involves forming an image (in reverse) on a retransfer intermediate sheet using one or more thermally transferable dyes. The image is then thermally transferred to a surface of an article by bringing the image into contact with the article surface and applying heat and possibly also pressure. Thermal transfer printing is particularly useful for printing onto articles that are not readily susceptible to being printed on directly, particularly three dimensional (3D) objects. Thermal retransfer printing by dye diffusion thermal transfer printing, using sublimation dyes, is disclosed, e.g., in WO 98/02315 and WO 02/096661. By using digital printing techniques to form the image on the retransfer intermediate sheet, high quality images, possibly of photographic quality, can be printed on 3D articles relatively conveniently and economically even in short runs. Indeed such objects can be personalised economically.

The image on the retransfer intermediate sheet can be formed by thermal transfer printing, e.g. as disclosed in WO 98/02315 and WO 02/096661. It is also possible to form the image on the retransfer intermediate sheet by inkjet printing using sublimation dyes. The media typically used for such retransfer printing comprises a paper substrate coated with layers which can absorb and then release the dyes printed in the inkjet process, e.g. as disclosed in EP 1102682. This type of material is very effective in transferring images to articles that are flat in two dimensions. However this material is not effective in transferring images to three dimensional objects. This is because the substrate used in the media is not flexible enough to form around the object without creasing and distorting. This results in uneven contact between the active surfaces, and prevents good transfer of the image onto the surface of the article to be decorated.

To overcome the problem of poor contact between active surfaces when attempting to retransfer printed images onto 3D articles, thermoformable substrates have been employed in place of a paper substrate. Typically the substrate used is amorphous polyethylene terephthalate, e.g. as disclosed in WO 01/96123 and WO 2004/022354. A problem often encountered in using such material is that the sublimation dyes typically used in this type of printing are very compatible with the substrate. Consequently, when carrying out the final retransfer step, the dyes can move into the substrate as well as transferring into the surface of the article being decorated, in a process called back diffusion. This means that not all the dye printed into the retransfer sheet is transferred to the final article, and limits the optical density achievable in the final image. As a result, images transferred lack contrast and are therefore perceived as being of low quality. To avoid back diffusion of dye into the substrate, barrier layers have been applied between the ink absorbing layer and the substrate. These barrier coatings are typically applied by sputtering of thin layers of metals such as aluminium. This adds substantially to the cost of the sheet assembly. In addition, such barrier layers tend not to be very flexible and can become crazed when the substrate is formed around the article to be decorated. The image that is subsequently transferred will reproduce this crazing through differential dye transfer, which once again detracts from the overall perceived quality of the final product.

U.S. Pat. No. 6,686,314 discloses a retransfer intermediate sheet comprising multiple layers on a substrate possibly of polyethylene terephthalate (PET), including an ink-absorbing layer that may contain porous silica gel and polymer such as polyvinyl alcohol.

SUMMARY OF THE INVENTION

In one aspect, the present invention provides a retransfer intermediate sheet for receiving an image to be printed onto an article by thermal retransfer, the sheet comprising a substrate; and an image-receiving coating on one side of the substrate, comprising an image-receiving layer for receiving an image by printing of dye-containing ink, the image-receiving layer comprising amorphous porous silica, a first, non-dye absorbing polymeric binder and a second, flexible polymeric binder.

In use, an image to be printed is formed (in reverse) on the image-receiving coating of the retransfer intermediate sheet by printing using dye-based inks. Suitable inks are often termed sublimation inks, although transfer can occur by diffusion or sublimation, or a mixture of both, depending on the degree of surface contact. Such inks usually incorporate the sublimation dyes in the form of a pigment dispersion. The image may be formed by a variety of printing techniques including screen printing, flexo printing etc. It is preferred to use digital printing techniques, particularly inkjet printing. Suitable inkjet printable sublimation dyes, having appropriate physical properties such as viscosity etc. to be inkjet printable, are commercially available, e.g. for use with Epson (Epson is a Trade Mark) and other makes of inkjet printer. The sheet is then placed with the image-receiving coating in contact with the surface of the article onto which it is desired to print, with the application of heat (and usually also pressure) resulting in dyes from the retransfer donor sheet transferring to the article surface to produce the desired printed image.

The image-receiving layer comprises a mixture of two compatible polymeric binders with particles of amorphous porous silica gel dispersed therethrough, preferably being reasonably homogeneous in composition. The layer is designed to be suitable for printing with inks containing sublimation dyes, for subsequent thermal transfer to an article. The layer is designed to be able to receive an image by inkjet printing, with the amorphous porous silica gel functioning to absorb liquid ink components. The first, non-dye absorbing polymeric binder functions to reduce the retention of the dye in the retransfer intermediate sheet on subsequent sublimation transfer. The second, flexible polymeric binder functions to provide flexibility on heating and deformation, preventing cracking of the layer, and also absorbs liquid components of the applied ink.

Amorphous porous silica gel has good absorption properties and is effective in absorbing a wide range of fluids including oil and water. It is preferred to use amorphous porous silica gel having an oil absorption characteristic (namely the amount of oil in grams that can be absorbed into 100 grams of silica gel in dry condition) in the range 50 to 350 grams of oil per 100 grams of silica, more preferably at least 200 grams of oil per 100 grams of silica. The silica gel preferably has an average particle size in the range 10 to 20 microns. Good results have been obtained using Syloid W900 (Syloid is a Trade Mark) silica gel from Grace Davison. This is a porous, pre-wetted (55% water by weight) grade of amorphous silica filler with an average particle size of 12 microns and an oil absorption characteristic when dry of about 300 grams of oil per 100 grams of silica.

The amorphous porous silica gel is typically present in an amount in the range 20 to 35%, preferably 25 to 30%, by weight of the total dry weight of the image-receiving layer.

The first, non-dye absorbing polymeric binder forms part of the main polymeric binder structure which binds together the amorphous porous silica gel particles and also participates in absorbing liquid components of the ink. Good results have been obtained with hydrolysed polyvinyl alcohols, preferably fully-hydrolysed polyvinyl alcohols, which do not absorb the types of dye used for sublimation transfer even when heated. It is preferred to use hydrolysed polyvinyl alcohols with relatively low molecular weights, and hence viscosities, for ease of coating. Suitable hydrolysed polyvinyl alcohols are commercially available, e.g. in the form of Mowiol 4/98 (Mowiol is a Trade Mark), which is a fully hydrolysed grade of polyvinyl alcohol with a low molecular weight (27,000) available from Kuraray Co. Ltd.

The first, non-dye absorbing polymeric binder is typically present in an amount in the range 15 to 30%, preferably 20 to 25%, by weight of the total dry weight of the image-receiving layer.

The second, flexible polymeric binder also forms part of the main polymeric binder structure which binds together the amorphous silica gel particles. This binder also prevents the layer from cracking during thermal deformation (typically up to 200%), and participates in absorbing the liquid components of the ink. The flexible binder is thus desirably capable of absorbing water to an extent to allow sufficient and rapid absorption of ink solvents during printing. Suitable binder materials include polyoxazolines (poly (2-ethyl-2-oxazoline)) and aqueous polyurethane dispersions, with poly (2-ethyl-2-oxazoline) being preferred currently. Poly (2-ethyl-2-oxazoline) is commercially available in a range of grades of different molecular weights, e.g. from 5,000 to 500,000, for instance as supplied by International Speciality Products (ISP) under the Trade Mark Aquazol. Good results have been obtained with Aquazol 50, which is a poly (2-ethyl-2-oxazoline) resin having a molecular weight of 50,000: this produces an image-receiving layer with good properties without having undesirably high solution viscosity.

The second, flexible polymeric binder is typically present in an amount in the range 35 to 65%, preferably 45 to 55%, by weight of the total dry weight of the image-receiving layer.

The image-receiving layer suitably has a thickness in the range 10 to 20 microns, e.g. about 15 microns.

The invention finds particular application in retransfer intermediate sheets which are useful in forming images on 3D articles as described above. Such sheets utilise deformable substrates particularly heat-deformable substrates, commonly PET, with which sublimation dyes are very compatible. To form an image on a typical 3D object the retransfer intermediate sheet, including the substrate on which it is coated, must be able to tolerate being stretched without fracture. Experience we have obtained when decorating a range of objects has determined that areas of the donor sheet need to be able to stretch to about three times their original length without cracking in order to decorate all the object surfaces. This is equivalent to a dimensional change of at least 200%. In such embodiments, the substrate and image-receiving coating are designed with these requirements in mind, with both components being able to deform sufficiently when suitably heated.

A heat-deformable substrate thus suitably comprises material that is deformable when heated, typically to a temperature in the range 80 to 170° C., preferably being sufficiently deformable to be vacuum formed under the action of heat. It is preferred to use substrates that will deform at as low a temperature as possible in order to be able to print on thermally sensitive materials, although it is more difficult to manufacture coated products using such substrates. The substrate preferably comprises an amorphous (non-crystalline) polyester, particularly amorphous polyethylene terephthalate (APET), as such materials have low heat-deformation temperatures. The substrate is typically in the form of a sheet or film and desirably has a thickness in the range 100 to 250 microns, e.g. about 150 microns. Good results have been obtained with a clear 150 micron thick amorphous grade of polyethylene terephthalate known by the Trade Mark PET 'A' supplied by Ineos Vinyls. This is thought to be the thinnest grade commercially available; it is more difficult to deform thicker grades around complex articles. Other substrate materials are available but some are less desirable; for example polyvinylchloride (PVC) films may be used but these can contain high levels of plasticiser which may tend to transfer into the article being treated, which is undesirable.

The image-receiving coating may include an optional prime layer between the substrate and the image-receiving layer. The prime layer improves adhesion of the image-receiving layer to the substrate, and suitably comprises a flexible polymeric material. In general the flexible polymeric material should be more flexible than the image-receiving layer to prevent loss of adhesion on deformation. Suitable polymeric materials include polyester resins available as aqueous dispersions of polyester resins of low glass transition temperature (Tg), i.e. having a Tg of less than 50° C., such as those supplied by Toyobo under the Trade Mark Vylonal, e.g. having a Tg of 20° C. Such polyester resins adhere well to amorphous polyester substrates. Such polyester resins generally have greater flexibility than the second, flexible polymeric binder, although this is not essential.

The image-receiving coating may include an optional dye barrier layer or dye management layer on top of the image-receiving layer. The dye barrier layer conveniently comprises a polymeric binder that functions to reduce diffusion of dye into the image-receiving layer during thermal transfer of dye from the sheet to an article in the final printing step. Suitable binder materials for this purpose include materials the same as or similar to those used as the first, non-dye absorbing polymeric binder of the image-receiving layer, particularly hydrolysed, preferably fully hydrolysed, polyvinyl alcohols. Good results have been obtained with Mowiol 20/98, which is a fully hydrolysed grade of polyvinyl alcohol with a molecular weight of 125,000 available from Kuraray Co Ltd.

The dye barrier layer may also comprise particles of amorphous porous silica dispersed through the binder, preferably in reasonably homogenous manner. The silica gel functions to enable liquid ink components to migrate into the image-receiving layer during initial inkjet printing. The silica gel also provides the sheet with some surface roughness, which considerably improves the elimination of air between the sheet and article surface during thermal transfer, e.g. under vacuum forming. The dye barrier layer typically has a thickness in the range 0.5 to 7.0 microns, preferably 0.5 to 1.5 microns, e.g. about 0.7 microns. The silica gel should have a suitably small particle size for incorporation into such a thin surface coating, e.g. having an average particle size of less than 10 microns. The silica gel may be generally of the same type as the silica gel used in the image-receiving layer, although a smaller particle size will usually be appropriate. For example, good results have been obtained using Syloid ED3 silica, which is a porous amorphous silica filler with an average particle size of 6 microns available from Grace Davison.

Low smoothness (or high roughness) of the image-receiving coating is necessary in order that air entrained between the sheet and the article being decorated can be evacuated from the surface of the article during the thermoforming stage. However if the smoothness is too low (roughness too high) transfer of colourant to the article during the transfer stage will be less effective. It is preferred that the surface of the image-receiving coating has a Bekk smoothness (by air leakage) for an air volume of 10 cubic centimeters, measured at 20° C., 60% relative humidity (RH), between 1 second and 20 seconds, more preferably between 1 second and 10 seconds.

It is also desirable that there is low friction between the surface of the image-receiving coating and the article being decorated in order that the sheet can move over the surface of the article during the thermoforming stage of the process. Preferably the coefficients of both static and dynamic friction, measured at 20° C., 60% RH, are less than 0.60, and more preferably less than 0.50, in order to deliver good performance during the thermoforming stage of the process. Although thermoforming actually occurs at high temperatures, we believe that lower temperature measurements correlate with performance during thermoforming.

Preferred dye management layers are disclosed in the specification of our British Patent Application No. 0623997.4.

In embodiments of the invention employing heat-deformable substrates, the sheets find particular application in printing on 3D articles, possibly having complex shapes including curved shapes (concave or convex) including compound curves. When printing onto 3D articles, the sheet is typically preheated, e.g. to a temperature in the range 80 to 170° C., prior to application to the article, to soften the sheet and render it deformable. The softened sheet is then in a condition in which it can be easily applied to and conform to the contours of an article. This is conveniently effected by application of a vacuum to cause the softened sheet to mould to the article. While the sheet is maintained in contact with the article, e.g. by maintenance of the vacuum, the sheet, and possibly also the article, is heated to a suitable temperature for dye transfer, typically a temperature in the range 140 to 200° C., for a suitable time, typically in the range 15 to 150 seconds. After dye transfer, the article is allowed or caused to cool before removal of the retransfer intermediate sheet. Suitable apparatus for performing the retransfer printing step is known, e.g. as disclosed in WO 01/96123 and WO 2004/022354.

The retransfer intermediate sheet of the invention finds particular application in use with thermal image retransfer equipment to decorate the surface of three dimensional objects. The objects can be made of a wide range of rigid materials including plastics, metal, ceramic, wood and other composite materials, with the objects either being of solid or thin-walled construction. One example of its use is in the decoration of automotive trim panels to enhance their surface appearance, but there are many other possible applications.

Depending on the nature of the surface of the article on which an image is to be formed, it may be appropriate to pre-treat the surface by application of a surface coating or lacquer to improve the take-up of transferred dyes. Suitable dye receptive lacquers and their method of use are known to those skilled in the art, e.g. as disclosed in EP 1392517. A lacquer is typically applied by spray coating, followed by oven curing at 90° C. for 50 minutes.

In a preferred aspect, the invention provides a retransfer intermediate sheet for receiving an image to be printed onto an article by thermal retransfer, the sheet comprising a heat-deformable substrate; and an image-receiving coating on one side of the substrate, comprising an image-receiving layer for receiving an image by inkjet printing of dye-containing ink the image-receiving layer comprising amorphous porous silica, a first, non-dye absorbing polymeric binder and a second, flexible polymeric binder.

The invention also includes within its scope a method of printing an image on an article using a retransfer intermediate sheet in accordance with the invention, comprising forming an image by printing, preferably inkjet printing, on the image-receiving coating of the sheet, bringing the coating into contact with a surface of the article and applying heat to cause thermal transfer of the image from the sheet to the article surface.

The invention also covers an article bearing a printed image produced by the method of the invention.

The invention, in preferred embodiments at least, has a number of advantages including the following:

- The retransfer intermediate sheet is very flexible and so is suited to vacuum forming, being able to tolerate high levels of dimensional change without damage.
- It is possible to achieve high levels of sublimation transfer of dye from the sheet to an article, e.g. at least 35%, thus producing images of good colour density.
- The sheet can be produced cheaply, and is economically attractive particularly compared to alternative approaches such as the use of substrates with metallic barrier layers or more complex multi-layer coating assemblies.
- The use of silica particles in the coating allows the sheet to conform to intricate shapes during vacuum-forming, providing a high degree of coverage of the transferred image to an article, even into small recesses.

A preferred embodiment of the invention will now be described, by way of illustration, in the following example. All percentages are by weight unless otherwise stated.

EXAMPLE

Materials

The example used the following materials, which are all commercially available.

Mowiol 4/98—a low molecular weight (mw=27,000) fully hydrolysed grade of polyvinyl alcohol, available from Kuraray Co Ltd (first binder).

Mowiol 20/98—a fully hydrolysed grade of polyvinyl alcohol with a molecular weight of 125,000, available from Kuraray Co. Ltd (binder in barrier layer).

Aquazol 50—a poly(2-ethyl-2-oxazoline) resin with a molecular weight of 50,000 supplied by International Speciality Products (second binder).

Syloid W900—a porous pre-wetted (55% water by weight) grade of amorphous silica filler with an average particle size of 12 microns, available from Grace Davison. The oil absorption of this material when dry is around 300 g of oil per 100 g of silica (for image-receiving layer).

Syloid ED3—a porous amorphous silica filler with an average particle size of 6 microns, available from Grace Davison (for barrier layer).

PET 'A'—a clear 150 micron thick, amorphous grade of polyethylene terephthalate film supplied by Ineos Vinyl (substrate).

Base Coat Formulation

Deionised water—64.5%

Mowiol 4/98—4.5% (first binder)

Aquazol 50—10% (second binder)

Methanol—10% (solvent)

Syloid W900—11% (amorphous porous silica gel)

(all percentages by weight)

The base coat formulation was prepared as follows:

Cold deionised water was measured into a mixer fitted with a heater jacket. The Mowiol 4/98 resin was then dispersed into the cold deionised water using a paddle mixer. Using the heater jacket, the solution temperature was then raised to 95° C. The solution temperature was maintained at this level for a further 30 minutes to ensure complete solvation. The solution was then cooled to 25° C. The Aquazol 50 binder and methanol were then added and the solution was mixed for a further 2 hours.

The final stage in the solution preparation process is the dispersion of the Syloid W900 silica. To ensure this filler is fully de-agglomerated and reduced to its primary particles, relatively high shear forces are required during the mixing process. This stage was therefore carried out using a saw-tooth type dispersing head, operating at a tip speed of 5-6 m/sec. The Syloid W900 silica was added into the vortex created by the dispersing head and mixed for 60 minutes.

Top/Barrier Coat Formulation

Deionised water—94.83%

Mowiol 20/98—5% (binder)

Syloid ED3—0.17% (amorphous porous silica gel)

(all percentages by weight)

The top coat formulation was prepared as follows:

Cold deionised water was measured into a mixer fitted with a heater jacket. The Mowiol 20/98 resin was then dispersed into the cold deionised water using a paddle mixer. Using the heater jacket, the solution temperature was then raised to 95° C. The solution temperature was maintained at this level for a further 30 minutes to ensure complete salvation. The solution was then cooled to 25° C. The Syloid ED3 silica was then dispersed into the solution using a saw-tooth type dispersing head, operating at a tip speed of 5-6 m/s.

The finished solutions were applied as 2 separate coatings onto the PET 'A' film substrate using a web coating machine. The base coat formulation was applied directly to the PET 'A' film base surface using a reverse gravure coating process. This coating was applied to achieve a dry coat thickness of about 13 microns. The coating was fully dried in the machine ovens before applying the barrier coating. The barrier coating was applied over the base coat using a reverse gravure coating process. The dry coat thickness of this layer is about 0.7 microns.

Because the substrate used for this application is a thermally unstable grade of PET, the maximum drying temperature is limited to 60° C.

The Bekk smoothness (by air leakage) for an air volume of 10 cubic centimeters, measured at 20° C., 60% RR, of the surface of the image-receiving coating was determined to be 3 seconds.

Utility

This inkjet receiver is intended as an image transfer or donor sheet. It is used with thermal image retransfer equipment to decorate the surface of three dimensional objects. The image retransfer technique is suitable for decorating the surface of a wide range of rigid materials. The object to be decorated can be made from plastic, metal, ceramic, wood or other composite materials and be of either thin-walled or solid construction. One example of its use is the decoration of automotive trim panels to enhance their surface appearance, but there are many other possible applications.

Brief Description of the Image Transfer Equipment

This example used a custom made bench-top unit, designed to thermally transfer images in order to decorate a 3D object. It can accommodate Euro A3 sized donor sheets. The base unit of the equipment contains a sliding tray assembly. This tray has a perforated base which allows air to be evacuated using a vacuum pump. The vacuum tray has a wide, flat rim onto which the preprinted donor sheet is mounted using a soft rubber gasket to ensure an air tight seal. Above this unit is a heater arrangement which is used during the vacuum forming and subsequent image transfer processes.

Forming an Image on the Donor Sheet

A mirror image is formed on the donor sheet using a suitable printer such as an Epson 1290 desktop inkjet printer. Sublimation ink cartridges are substituted for the standard dye based inks. Several manufacturers produce suitable sublimation cartridges for inkjet printers. These are commercially available for various models of Epson printer. The present work was carried out using ArTitanium sublimation inks (ArTitanium is a trade mark) supplied by Sawgrass Technologies, Inc.

Preparation of the Object

For successful thermal transfer to take place, the object surface has to be receptive to sublimation dyes. Some materials are naturally more receptive to sublimation dyes and need no further preparation. Other materials, however, require the application of a surface coating or lacquer to improve the take-up of sublimation dyes. This lacquer is applied by a spray coating technique and this is followed by oven curing at 90° C. for 50 minutes. A suitable dye receptive lacquer formulation is detailed in EP 1392517.

Description of the Decoration Process

The object to be decorated is mounted in the vacuum tray of the equipment. A previously printed donor sheet is mounted in such a way that the imaged side of the film faces towards the object to be decorated.

The donor sheet is then heated until it reaches a temperature of 100-140° C. This softens the PET 'A' substrate prior to the vacuum forming stage.

The vacuum pump is now used to evacuate air from the tray, thus causing the softened donor sheet to mould itself around all exposed surfaces of the object.

Whilst maintaining a vacuum, the 'wrapped' object is then heated to 140-200° C. During this stage the dyes in the donor sheet diffuse into the receptive surface of the object. Depending on the size and type of material to be decorated this process can take between 15 and 150 seconds. The object is allowed to cool before removing the donor sheet.

When heated, the sheet can stretch to at least three times its original length without cracking, which is equivalent to a dimensional change of at least 200%.

The sheet was used successfully to transfer fall colour images of photographic quality to a range of different three dimensional articles of different materials. Good transfer of dye to the articles of at least 35% was obtained, resulting in production of images of good colour density on the articles.

Measurements of the friction of the surface of the image-receiving coating of the sheet with respect to a lacquer-coated mobile phone casing back determined the static friction coefficient to be 0.28, and the dynamic friction coefficient to be 0.26, measured at 20° C., 60% RH, indicating that the friction between the surfaces is low.

The invention claimed is:

1. A retransfer intermediate sheet for receiving an image to be printed onto an article by thermal retransfer, the sheet comprising a substrate; and an image-receiving coating on one side of the substrate, comprising an image-receiving layer for receiving an image by printing of dye-containing ink, the image-receiving layer comprising an amorphous porous silica in an amount in the range of 25 to 35% by weight of the total dry weight of the image receiving layer, a first, non-dye absorbing polymeric binder in an amount in the range of 15 to 30% by weight of the total dry weight of the image-receiving layer, and a second, flexible polymeric binder.

2. A sheet according to claim 1, wherein the substrate comprises amorphous polyethylene terephthalate.

3. A sheet according to claim 1 or 2, wherein the substrate comprises a sheet or film having a thickness in the range 100 to 250 microns.

4. A sheet according to claim 1, wherein the amorphous porous silica has an oil absorption characteristic in the range 50 to 350 grams of oil per 100 grams of silica.

5. A sheet according to claim 1, wherein the amorphous porous silica has an average particle size in the range 10 to 20 microns.

6. A sheet according to claim 1, wherein the amorphous porous silica is present in an amount in the range of 25 to 30% by weight of the total dry weight of the image-receiving layer.

7. A sheet according to claim 1, wherein the first, non-dye absorbing polymeric binder comprises hydrolysed polyvinyl alcohol.

8. A sheet according to claim 1, wherein the first, non-dye absorbing polymeric binder is present in an amount in the range 20 to 25% by weight of the total dry weight of the image-receiving layer.

9. A sheet according to claim 1, wherein the second flexible polymeric binder comprises poly(2-ethyl-2-oxazoline).

10. A sheet according to claim 1, wherein the second, flexible polymeric binder is present in an amount in the range 35 to 65% by weight of the total dry weight of the image-receiving layer.

11. A sheet according to claim 1, wherein the image-receiving layer has a thickness in the range 10 to 20 microns.

12. A sheet according to claim 1, further comprising a prime layer between the substrate and the image-receiving layer.

13. A sheet according to claim 12, wherein the prime layer comprises a polyester resin available as an aqueous dispersion.

14. A sheet according to claim 1, further comprising a dye barrier layer on top of the image-receiving layer, comprising a polymeric binder and an amorphous porous silica gel.

15. A sheet according to claim 14, wherein the polymeric binder comprises a hydrolysed polyvinyl alcohol.

16. A sheet according to claim 14 or 15, wherein the dye barrier layer has a thickness in the range 0.5 to 5.0 microns, and the amorphous porous silica gel has an average particle size of less than 10 microns.

17. A method of printing an image on an article using a retransfer intermediate sheet in accordance with claim 1, comprising forming an image by printing on the image-receiving coating of the sheet, bringing the coating into contact with a surface of the article and applying heat to cause thermal transfer of the image from the sheet to the article surface.

18. A method according to claim 17, wherein the image is formed by inkjet printing.

19. An article bearing a printed image produced by the method of claim 17.

* * * * *